US008804983B2

(12) United States Patent
Akino

(10) Patent No.: US 8,804,983 B2
(45) Date of Patent: Aug. 12, 2014

(54) MICROPHONE AND MICROPHONE APPARATUS

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 259 days.

(21) Appl. No.: 13/291,197

(22) Filed: Nov. 8, 2011

(65) Prior Publication Data

US 2012/0114159 A1 May 10, 2012

(30) Foreign Application Priority Data

Nov. 9, 2010 (JP) ..... 2010-250708

(51) Int. Cl.
*H04R 3/00* (2006.01)

(52) U.S. Cl.
USPC ..... 381/113; 381/174; 381/111; 381/355

(58) Field of Classification Search
USPC ..... 381/374, 369, 174, 111, 113, 355, 170, 381/186; 340/533
See application file for complete search history.

(56) References Cited

U.S. PATENT DOCUMENTS 6,702,584 B2 * 3/2004 Ueshima et al. ..... 434/307 A
8,559,657 B2 * 10/2013 Akino et al. ..... 381/111

FOREIGN PATENT DOCUMENTS

JP 08-033090 2/1996
JP 2006-197284 7/2006

* cited by examiner

*Primary Examiner* — Curtis Kuntz
*Assistant Examiner* — Joshua A Kaufman
(74) *Attorney, Agent, or Firm* — Whitham Curtis Christofferson & Cook, PC

(57) ABSTRACT

A microphone includes a microphone unit having a diaphragm, a fixed electrode and a FET as an impedance converter; a plug outputting audio signals output from the microphone unit; and a jack into which audio signals inputted in the microphone unit are inputted. While the plug of the other microphone is inserted in the jack of the microphone, the audio signals output from the other microphone unit are added to the audio signals output from the microphone unit and are output.

7 Claims, 5 Drawing Sheets

RELATED ART

MICROPHONE AND MICROPHONE APPARATUS

BACKGROUND OF THE INVENTION

1. Field of the Invention

The present invention relates to a microphone which is to be connected to and operated along with a plurality of microphones, and a microphone apparatus including the microphones.

2. Related Background Art

Among electret condenser microphones, a known electret condenser microphone of a drain output type (two-wire system) yields an output from a drain of a FET (field-effect transistor) as an impedance converter (refer to Japanese Unexamined Patent Application Publication No. H8-33090, for example). Such a type of an electret condenser microphone is referred to as a "plug-in power system," for example. FIG. 5 illustrates a typical electret condenser microphone of a plug-in power type.

In FIG. 5, a microphone unit 100 includes a microphone capsule 110, which has an electret member in either a diaphragm or a fixed electrode, and a FET 120 as an impedance converter. In the plug-in power system, a load resistor RL and a DC power source Vcc are connected in series to a drain D of the FET 120 such that a variable voltage across the load resistor RL is obtained from output terminals T1 and T2.

The FET 120 is of a bias built-in type having a diode and a high-value resistor which are connected between a gate G and a source S. A drain current is fixed to a drain current value (Idss) at a voltage of 0 between the gate G and the source S. Connecting a plurality of microphone units 100 in parallel to the load resistor RL synthesizes audio signals from the microphone units.

The plurality of microphone units 100 connected to the load resistor RL, however, cause the DC voltage to vary across the load resistor RL depending on the number of units. The DC voltage across the load resistor RL thus approaches the power voltage of the DC power source Vcc depending on the number of connected units. The voltage between the drain D and the source S of the FET 120 is then extremely reduced, preventing the FET 120 from operating.

To prevent a reduction in operating current of the impedance converter due to parallel connection of the microphone units, the resistance value of the load resistor RL is properly switched depending on the number of connected microphone units. Since the resistance value of the load resistor RL, however, should be switched during installation or use, it is practically cumbersome and inconvenient.

In order to address such a cumbersome and inconvenient circumstance, a method is known to use an output transformer instead of the load resistor RL. According to the method, the voltage between the drain D and the source S of the FET 120 is not reduced regardless of the number of connected microphone units (consumption current). Unfortunately, the DC current flowing to the output transformer generates DC magnetization that leads to a decline in performance of the transformer.

To address the circumstances above, a known microphone apparatus has an output transformer and a current mirror circuit in an output circuit and a plurality of microphones can be connected in parallel to the apparatus without special adjustment (refer to Japanese Unexamined Patent Application Publication No. 2006-197284, for example).

FIG. 4 illustrates a typical microphone apparatus as disclosed in Japanese Unexamined Patent Application Publication No. 2006-197284. In the microphone apparatus shown in FIG. 4, a plurality of microphone 100*a* to 100*c* are connected in parallel to a microphone apparatus main body 200. Each of the microphone 100*a* to 100*c* has the same configuration as the electret condenser microphone unit shown in FIG. 5. The microphone units 100*a* to 100*c* have microphone capsules 110*a* to 110*c*, respectively, each having an electret member in either a diaphragm or a fixed electrode; and FETs 120*a* to 120*c*, respectively, each serving as an impedance converter. The fixed electrode is connected to a gate G of each of the FETs 120*a* to 120*c*. The diaphragm is grounded along with a source S of each of the FETs 120*a* to 120*c*.

The apparatus main body 200 has a DC power source Vcc, an output transformer 201 outputting audio signals and used as a load, and a current mirror circuit 204. A primary winding 202 of the output transformer 201 is split into a first winding 202*a* and a second winding 202*b* by a center tap 202*c*. Drains D of the FETs 120*a* to 120*c* of the microphone units 100*a* to 100*c*, respectively, are connected in parallel to the first winding 202*a*. The current mirror circuit 204 is connected to the second winding 202*b*. The center tap 202*c* is connected to the positive electrode of the DC power source Vcc. A secondary winding 203 of the output transformer 201 is connected to an audio output circuit (not shown in the drawing).

In the microphone apparatus disclosed in Japanese Unexamined Patent Application Publication No. 2006-197284, the current mirror circuit 204 can generate an operating current which increases according to an increase in the number of connected microphone units. Furthermore, in the primary winding 202 of the output transformer 201, the current flows in directions opposite to each other in the first winding 202*a* and the second winding 202*b* as viewed from the center tap 202*c*, thus preventing saturation of the DC current. The microphone apparatus disclosed in Japanese Unexamined Patent Application Publication No. 2006-197284, however, requires the output transformer and the current mirror circuit and has a high AC impedance of the FET drains, thus susceptible to external noise.

SUMMARY OF THE INVENTION

In view of the circumstances above, an object of the present invention is to provide a plurality of microphones connected in parallel to a power source for operation and a microphone apparatus including the microphones in a simpler configuration without using an output transformer and a current mirror circuit.

The present invention relates to a microphone that includes a microphone unit having a diaphragm, a fixed electrode and a FET as an impedance converter; a plug outputting audio signals output from the microphone unit; and a jack into which audio signals inputted in the microphone unit are inputted. While the plug of the other microphone is inserted in the jack, the audio signals output from a microphone unit of the other microphone are added to the audio signals output from the microphone unit and are output.

The present invention also relates to a microphone apparatus that includes a microphone unit having a diaphragm, a fixed electrode and a FET as an impedance converter; a plug outputting audio signals output from the microphone unit; and a jack audio signals inputted in the microphone unit are inputted. While the plug of the other microphone is inserted in the jack of the microphone, a signal line of the diaphragm of the microphone unit and the plug of the microphone are electrically connected and the audio signals output from the other microphone are added to the audio signals output from the microphone and are output.

The present invention provides a plurality of microphones connected in parallel to a power source for operation and a microphone apparatus including the microphones in a simple configuration.

DESCRIPTION OF THE PREFERRED EMBODIMENTS

Figure 1:
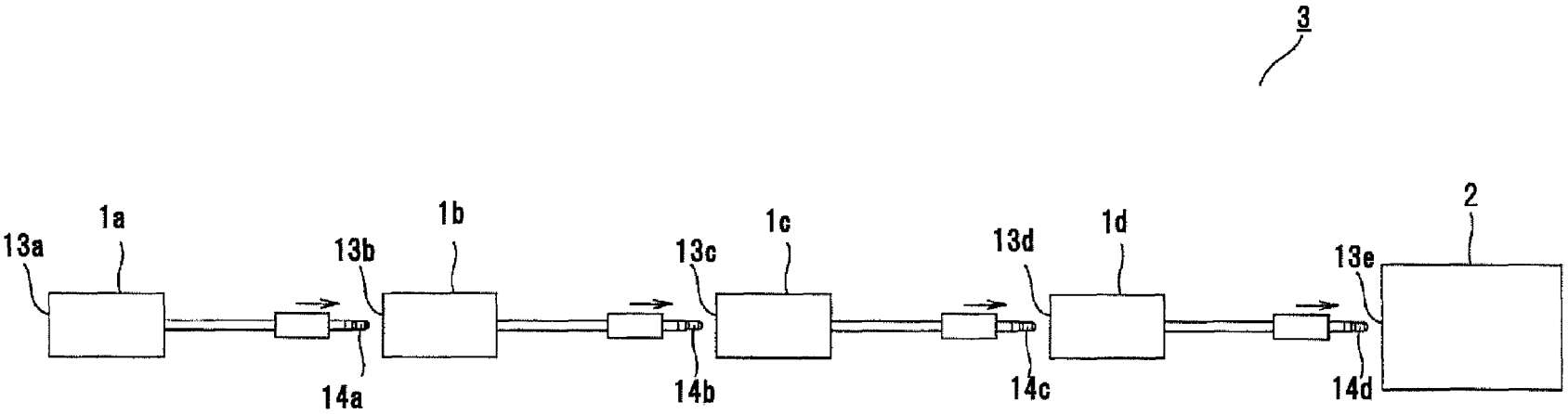
FIG. 1 is a schematic view of a configuration of a microphone apparatus according to an embodiment of the present invention.

A microphone and a microphone apparatus according to an embodiment of the present invention are explained below with reference to the attached drawings. FIG. 1 is a schematic view of the microphone and the microphone apparatus according to the embodiment of the present invention. In a microphone apparatus 3 shown in FIG. 1, a plurality of microphones 1*a* to 1*d* are connected nose to tail in series and the last-stage microphone 1*d* is connected to a device 2 that includes a power source. Each of the microphones 1*a* to 1*d* has plugs 14*a* to 14*d* as output terminals and jacks 13*a* to 13*d* as input terminals (not shown in the drawing) provided on the left side in FIG. 1. The plug 14*a* of the first-stage microphone 1*a* is connected to the jack 13*b* of the second-stage microphone 1*b*, and the plug 14*b* of the second-stage microphone 1*b* is connected to the jack 13*c* of the third-stage microphone 1*c*. Continuously making such a connection provides nose-to-tail connection or daisy chain connection of the microphones 1*a* to 1*d*.

The plug 14*d* of the last-stage microphone 1*d* is connected to the device 2, from which an operating current is supplied from the power source included in the device 2 through a jack 13*e* thereof. The operating current is supplied from the last-stage microphone 1*d* toward the first-stage microphone 1*a* through the connection of the jacks 13*a* to 13*d* and the plugs 14*a* to 14*d* of the respective microphones 1*a* to 1*d*. Specifically, the microphones 1*a* to 1*d* are connected in parallel to the power source.

According to the microphones and the microphone apparatus of the present invention, the plurality of microphones are daisy-chain connected to the power source, thus reducing installation work, such as wiring for connection of a large number of microphones.

Figure 2:
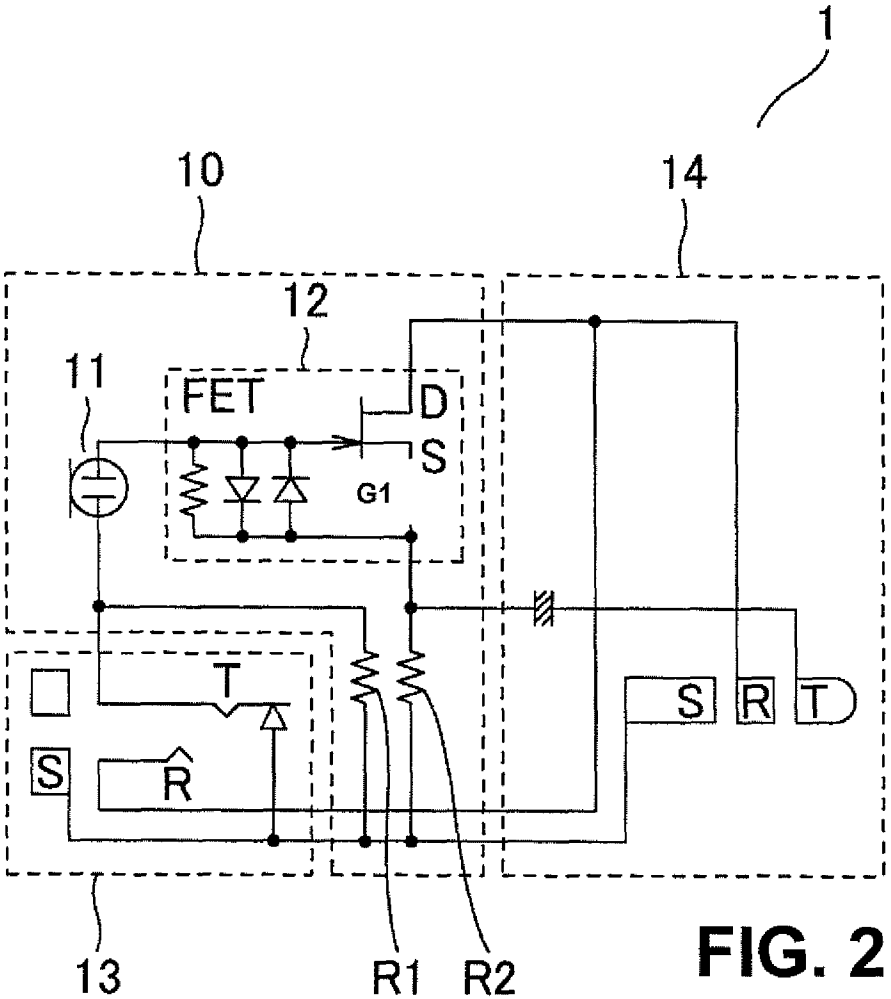
FIG. 2 is a circuit diagram of an exemplary microphone according to an embodiment of the present invention.

The microphone according to the present invention is described below in more detail. FIG. 2 is a circuit diagram illustrating the microphone according to an embodiment of the present invention. In FIG. 2, a microphone 1 has a microphone unit 10, which is an electret condenser microphone unit; a jack 13 as an input terminal; and a plug 14 as an output terminal. The microphone 1 in FIG. 2 indicates the microphones 1*a* to 1*d* in FIG. 1, and a configuration and a function thereof are similar to those of the microphones 1*a* to 1*d*. A configuration and a function of the jack 13 are similar to those of the jacks 13*a* to 13*d*. A configuration and a function of the plug 14 are similar to those of the plugs 14*a* to 14*d*.

The microphone unit 10 includes a microphone capsule 11 that has an electret member in either a diaphragm or a fixed electrode and a FET 12 as an impedance converter. The fixed electrode of the microphone capsule 11 is connected to a gate G of the FET 12. The diaphragm of the microphone capsule 11 is connected to a signal terminal T of the jack 13 and to the plug 14 and a ground terminal S of the jack 13 through a resistor R1. A drain D of the FET 12 is connected to a power source terminal R of the plug 14. A source S is connected to a signal terminal T of the plug 14 through a coupling capacitor and to the plug 14 and the ground terminal S of the jack 13 through a resistor R2.

The plug 14 has three terminals, i.e., the signal terminal T connected to the coupling capacitor, the power source terminal R, and a ground terminal S.

The jack 13 has also three terminals that correspond to those of the plug 14. In detail, the jack 13 includes the signal terminal T, a power source terminal R, and the ground terminal S, which correspond to the three respective terminals (i.e., the signal terminal T, the power source terminal R, and the ground terminal 5) of the plug 14. FIG. 2 illustrates a state where a plug 14 of another microphone 1 is not inserted into the jack 13. As shown in FIG. 2, the signal terminal T of the jack 13 is grounded in the state where the plug 14 is not inserted into the jack 13. Specifically, the diaphragm of the microphone capsule 11 is grounded, thus allowing the microphone 1 to operate as a stand-alone microphone as well.

When the plug 14 of another microphone (subsequent microphone) 1 (not shown in the drawing) is inserted into the jack 13, the signal terminal T of the jack 13 is disconnected from the ground and is connected to a signal terminal T of the plug 14 of the subsequent microphone 1. In other words, the signal terminal T of the plug 14 of the subsequent microphone 1 is connected to the diaphragm of the preceding microphone 1 and signals from the subsequent microphone 1 are ready to be added to audio signals. Added audio signals are output from the signal terminal T of the plug 14 of the preceding microphone 1. In the preceding microphone 1 into which the plug 14 of the subsequent microphone 1 is inserted, the diaphragm of the microphone capsule 11 is grounded through the resistor R1, thus ensuring audio signal output.

The operating current of the preceding microphone 1 is supplied through the power source terminal R of the plug 14 connected to the subsequent microphone 1. Since the power source terminal R is connected to the drain D of the FET, the operating current is supplied to the drain D of the FET 12 and is further supplied to the preceding microphone 1 through the power source terminal R of the jack 13 thereof. Thus, in daisy chain connection in which the plug 14 is inserted into the jack 13 of a subsequent microphone 1 to make a nose-to-tail connection, the operating current supplied from the power source (not shown in the drawing) is sequentially supplied through the plug 14 and the jack 13. Specifically, disconnecting the plug 14 from the jack 13 allows the microphones 1 according to the embodiment to each operate as a stand-alone microphone, while connecting the jack 13 to the plug 14 electrically connects the terminal of the diaphragm and the preceding output terminal, thus outputting added audio signals output from the microphones 1.

Figure 3:
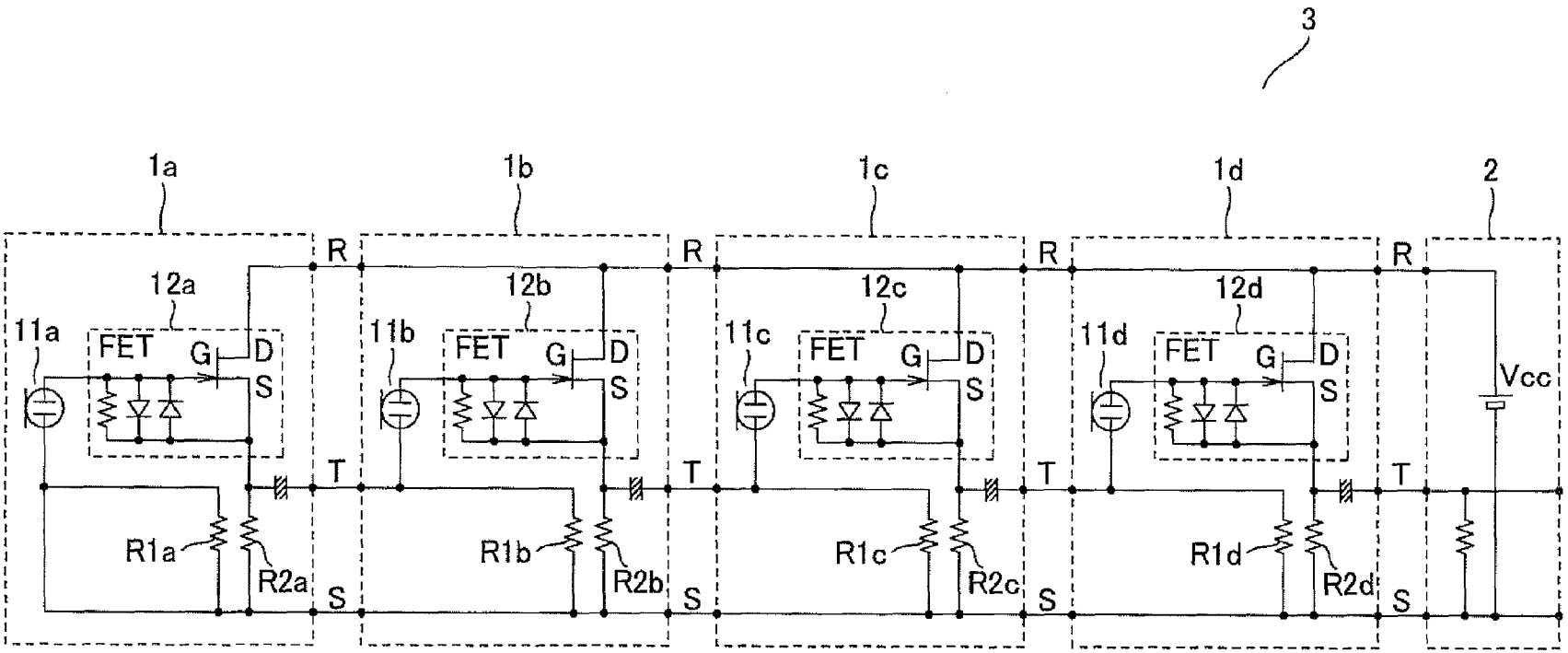
FIG. 3 is a circuit diagram illustrating connection of a microphone apparatus according to an embodiment of the present invention.
Figure 4:
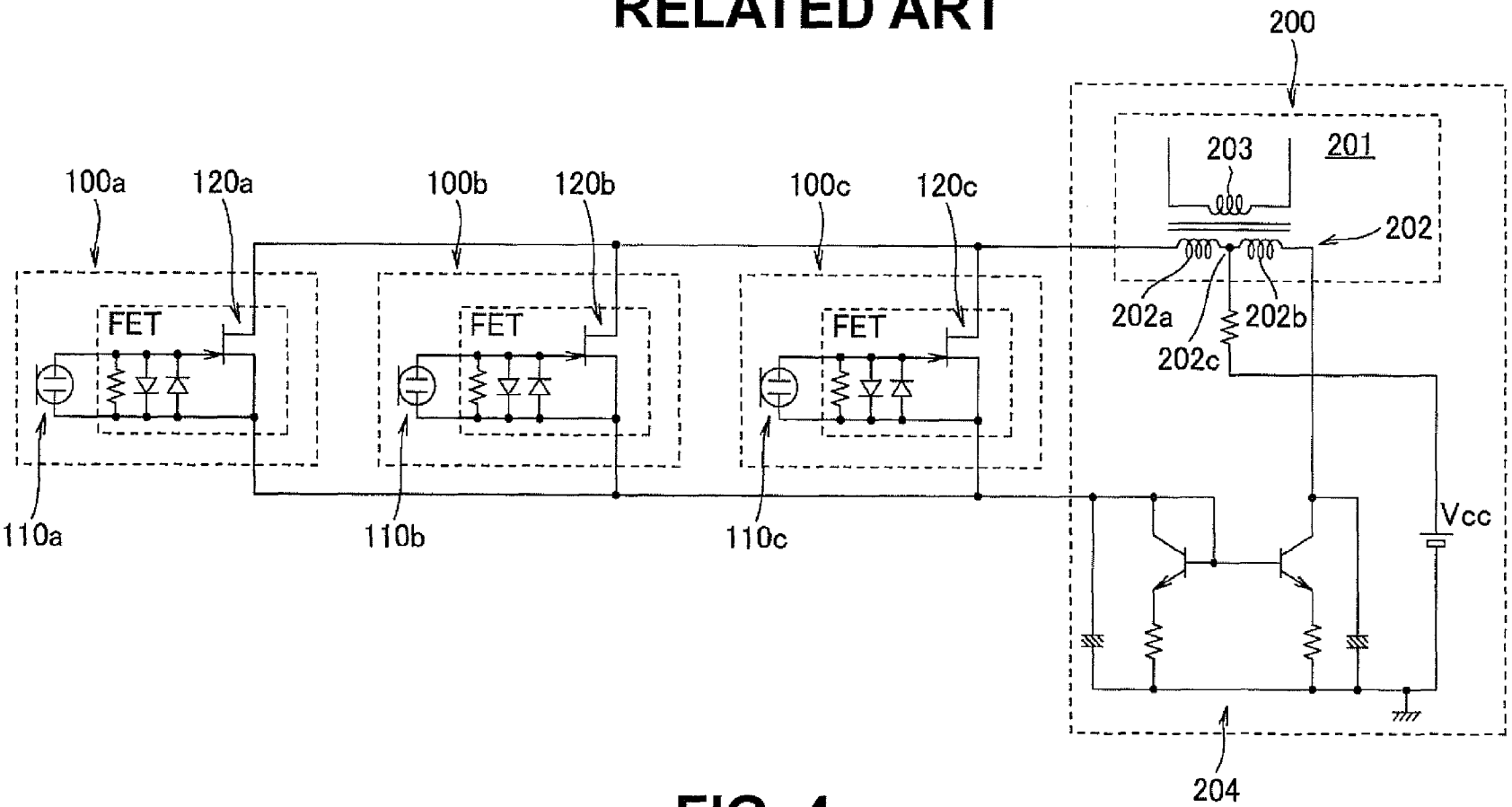
FIG. 4 is a circuit diagram of a typical conventional microphone apparatus.
Figure 5:
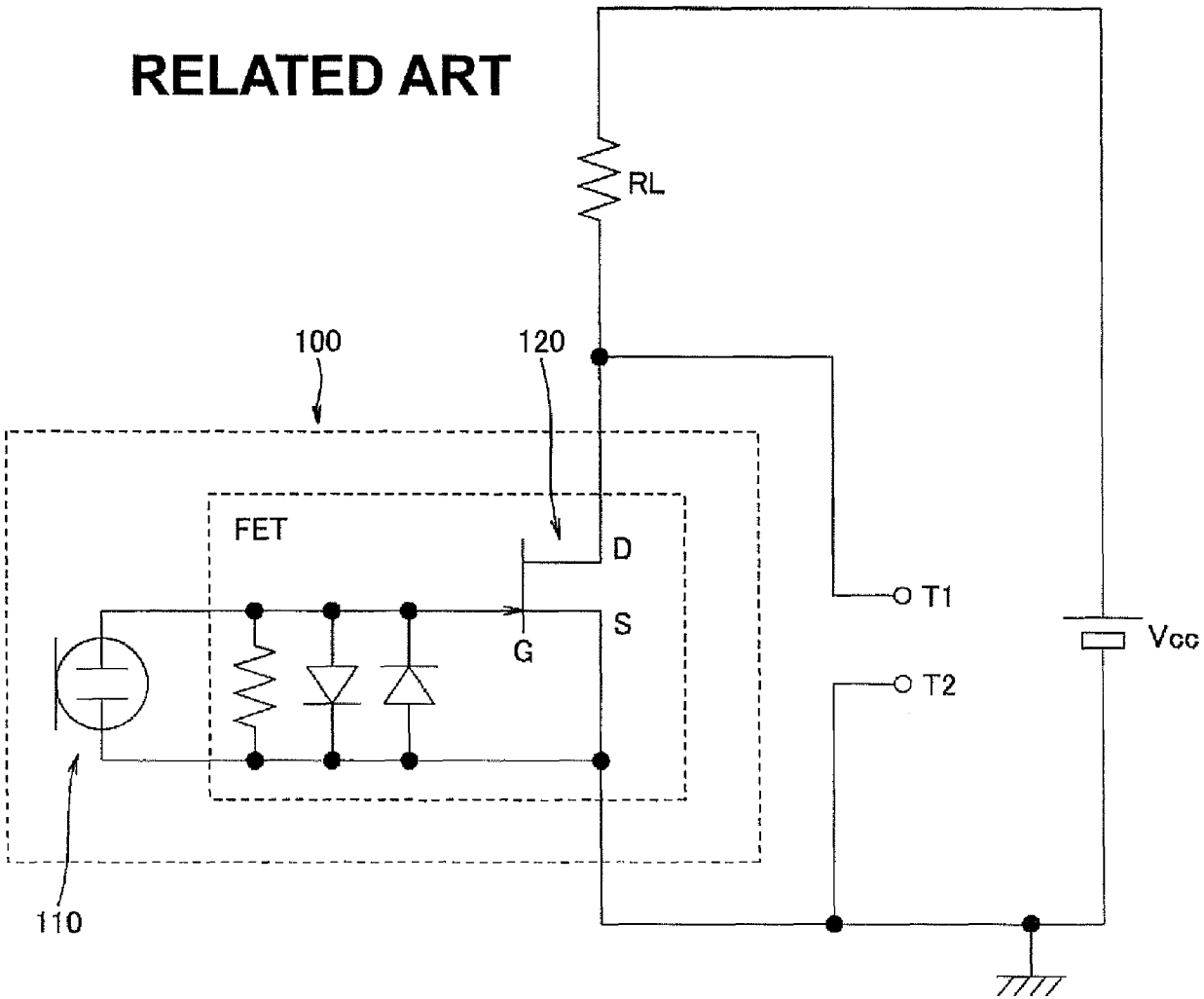
RELATED ART FIG. 5
FIG. 5 is a schematic circuit diagram illustrating a configuration of a conventional microphone of a drain output type (two-wire system).

An embodiment is described below with reference to FIG. 3 in which microphones of the present embodiment are daisy-chain connected to operate as a microphone apparatus. With reference to FIG. 3, a microphone apparatus 3 has a plurality of microphones 1*a* to 1*d* and a device 2 that includes a power source Vcc. The four microphones (1*a* to 1*d*) are used in the embodiment for explanation purposes. The microphone apparatus of the present invention, however, is not limited to this number of microphones and may have a larger number of microphones to be connected within the permissible range of operating current supplied from the power source.

Plugs 14 and jacks 13 are omitted in FIG. 3. As shown in the drawing, power source terminals R of the respective microphones 1*a* to 1*d* are connected to drains D of FETs 12, each of which serves as an impedance converter, of the respective microphones 1*a* to 1*d* and then to the power source Vcc. Ground terminals S are connected to diaphragms of the respective microphones 1*a* to 1*d* through resistors R1*a*, R1*b*, R1*c*, and R1*d*, respectively. Signal terminals T, which are signal output terminals of the respective microphones 1*a* to 1*d*, are each connected to the diaphragm of the subsequent microphone 1. Thus, the respective microphones 1*a* to 1*d* are connected in parallel with respect to the power source and in series with respect to the audio signals. In FIG. 3, resistors R2*a*, R2*b*, R2*c*, and R2*d* are connected between sources of the FETs of the respective microphones 1*a* to 1*d* and the ground.

The FET 12, which is a drain-grounded circuit, has an amplification of substantially 1. Thus, even if audio signals output from the plurality of microphones 1 are connected in series, the signals are not amplified excessively and are output according to the input from the microphone units 11 of the respective microphones 1. The microphone apparatus according to the present invention can thus add signals input from the plurality of microphones into single signals for output without fluctuation in the level regardless of addition of the signals.

As described above, the microphone apparatus according to the present invention does not require a current mirror circuit or an output transformer in the output circuit. With the source follower configuration, the microphone apparatus has low AC impedance and audio signals are less susceptible to external noise.

The microphone apparatus having microphones connected in parallel according to the present invention is applicable, for example, to a microphone apparatus in a conference room and a security system used along with a security camera.

What is claimed is:

1. A microphone comprising:

a first microphone unit comprising a diaphragm, a fixed electrode and a FET as an impedance converter;

a first plug outputting audio signals output from the first microphone unit; and a jack into which audio signals inputted in the first microphone unit are inputted, wherein the microphone is connectable to a subsequent microphone that is different from the microphone, wherein one of the diaphragm and the fixed electrode is comprised of an electret member, wherein the jack is connectable to a second plug of the subsequent microphone, the second plug includes a signal output terminal, wherein, while the second plug of the subsequent microphone is inserted in the jack of the microphone, the signal output terminal of the subsequent microphone is directly connected to the diaphragm of the microphone, audio signals output from a second microphone unit of the subsequent microphone are added to the audio signals output from the first microphone unit and are output.

2. The microphone according to claim 1, wherein, while the second plug of the subsequent microphone is not inserted in the jack of the microphone, the jack is grounded, and wherein, while the second plug of the subsequent microphone is inserted in the jack of the microphone, a signal terminal of the jack and a signal terminal of the second plug are connected.

3. The microphone according to claim 2, wherein the second plug and the jack each include the signal terminal, a power source terminal, and a ground terminal.

4. The microphone according to claim 1, wherein the impedance converter serves as a drain-grounded circuit.

5. The microphone according to claim 1, wherein, while the second plug of the subsequent microphone is inserted in the jack of the microphone, a signal line of the diaphragm of the first microphone unit and the second plug of the subsequent microphone are electrically connected, and the audio signals output from the subsequent microphone are added to the audio signals output from the microphone and are output.

6. A microphone apparatus comprising;

a plurality of nose-to-tail connected microphones, wherein the plurality includes at least one of a first microphone and a second microphone, the first microphone comprising:

a first microphone unit comprising a diaphragm, a fixed electrode, and a FET as an impedance converter;

a first plug outputting audio signals output from the first microphone unit; and a jack into which audio signals inputted in the first microphone unit are inputted, wherein the first microphone is connectable to the second microphone, the second microphone being different from the first microphone, wherein one of the diaphragm and the fixed electrode is comprised of an electret member, wherein the jack is connectable to a second plug of the second microphone, the second plug includes a signal output terminal, wherein, while the second plug of the second microphone is inserted in the jack of the first microphone, the signal output terminal of the second microphone is directly connected to the diaphragm of the first microphone, and audio signals output from a second microphone unit of the second microphone are added to the audio signals output from the first microphone unit and are output.

7. A microphone apparatus comprising:

a first microphone comprising:

a microphone unit comprising a diaphragm, a fixed electrode and a FET as an impedance converter;

a first plug outputting audio signals output from the microphone unit; and a jack into which audio signals inputted in the microphone unit are inputted, wherein, while a second plug of a second microphone is inserted in the jack of the first microphone, a signal line of the diaphragm of the microphone unit and the second plug of the second microphone are electrically connected, a signal output terminal of the second microphone is directly connected to the diaphragm of the first microphone, and audio signals output from the second microphone are added to the audio signals output from the first microphone and are output.

* * * * *